United States Patent [19]

Woods

[11] Patent Number: 4,638,513

[45] Date of Patent: Jan. 27, 1987

[54] LATERALLY STABILIZED BRA STRAP

[76] Inventor: Alma J. Woods, 2400 Oneida, Denver, Colo. 80207

[21] Appl. No.: 801,292

[22] Filed: Nov. 25, 1985

[51] Int. Cl.[4] ..... A41D 27/26

[52] U.S. Cl. ..... 2/268; 128/510

[58] Field of Search ..... 2/268, 338, 323, 73, 2/237; 128/510

[56] References Cited

U.S. PATENT DOCUMENTS 2,689,350 9/1954 Crawford ..... 2/268

4,472,838 9/1984 Pompa ..... 2/268

*Primary Examiner*—Doris L. Troutman

*Attorney, Agent, or Firm*—Joseph C. Herring

[57] ABSTRACT

An improved strap adapted to be worn adjacent the skin is made up of an elastic ribbon having flexibility in the longitudinal direction and limited lateral flexibility. A soft padding covers the elastic ribbon, and a smooth-faced material outer covering encloses both. The components of the strap are attached along the longitudinal edges of the strap to form a smooth-faced material surface with undulations (wrinkles) permitting limited longitudinal stretching of the elastic strap to produce a smooth strap surface during wear. The elasticized strap material makes up a major portion of the strap which, preferably, also includes non-elasticized end portions for attachment to garments, clips, etc.

19 Claims, 4 Drawing Figures

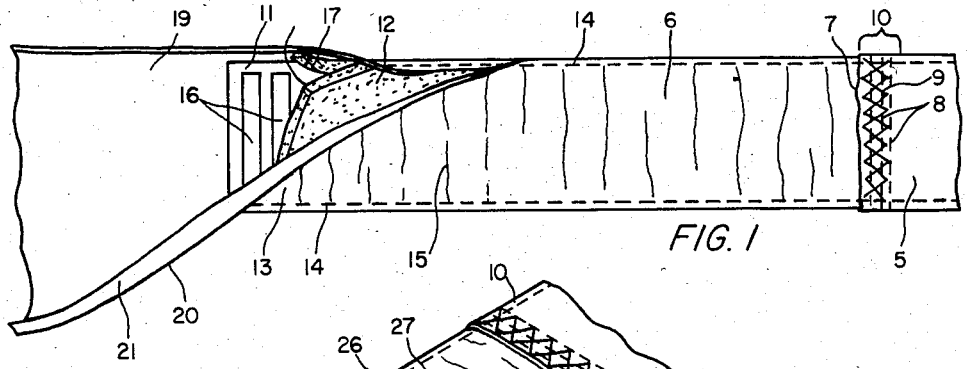
FIG. 1
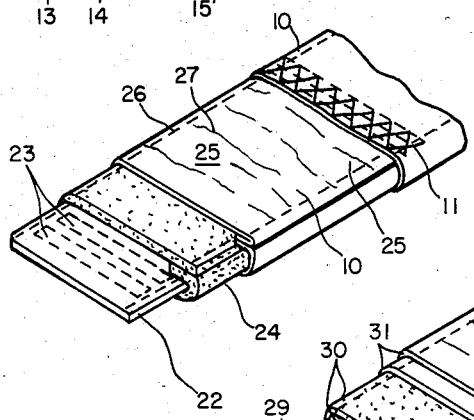
FIG. 2
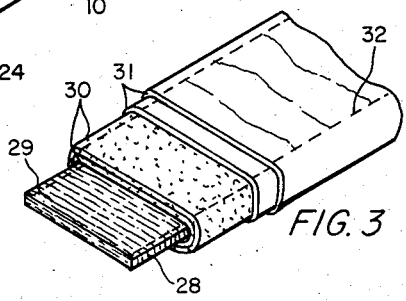
FIG. 3
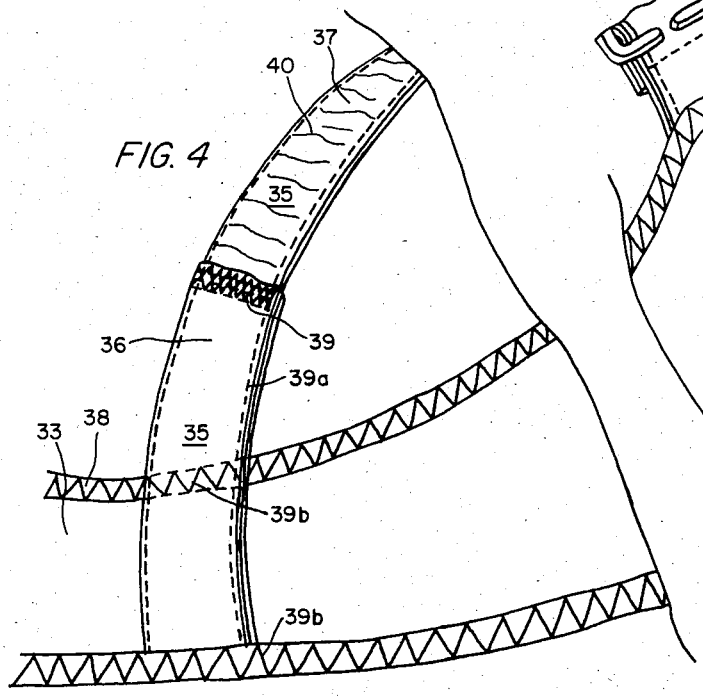
FIG. 4
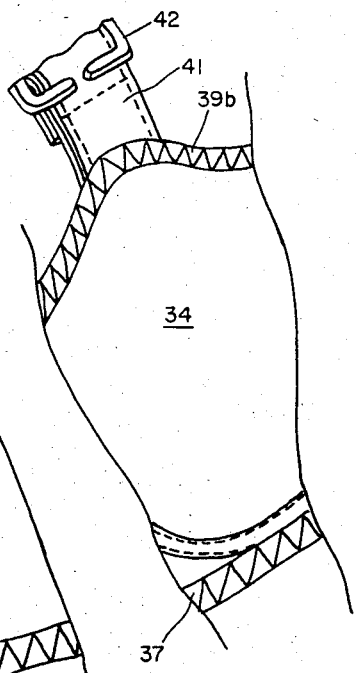

LATERALLY STABILIZED BRA STRAP

BACKGROUND OF THE INVENTION

This invention relates to straps useful with load-bearing garments and devices to be worn adjacent the skin, i.e., brassieres, halters, bra-less dresses and packs for summer usage, for example, baby packs.

The invention of the brassiere concept solved some problems but created others. One of these problems was to provide garment straps which were as comfortable as possible, taking into consideration the materials available for strap construction at any given time. There has always been a need for a combination of elasticity with sufficient restraint to provide the necessary breast support.

Many approaches have been taken to the solution of this problem. For example. U.S. Pat. No. 1,661,130 issued to David Rothstein, and teaches the use of an inelastic strap having, at one or both ends, a sheath into which an elastic band fits. The hidden elastic band is connected, at the top of the sheath, to the strap on one end and the garment on the other. The result is a brassiere strap which appears to be made of inelastic material along its entire length because the elastic ribbon is substantially hidden within the sheath.

U.S. Pat. No. 1,887,939 issued to Grace J. Lyons teaches a garment strap having a "take up" means made up of elastic elements combined with the inelastic strap. The elasticity of the take-up means is sufficient to take up the slack in the inelastic member but insufficient, alone, to support the garment.

U.S. Pat. No. 2,132,616, issued to Harry Hardie, teaches a strap having an elastic rubber strip enclosed by a non-stretchable fabric. The edges of the material covering the rear of the strap overlap the front of the strap on each side and are sewn to a strip of inelastic biased fabric having turned-under edges by stitching along the longitudinal edges of the strap. After the strap is sewn, the sheet rubber is under sufficient tension to normally retain the non-stretchable fabric in a shirred condition.

Another problem has existed for an equally long period of time. That is the problem of preventing the strap from curling and thereby reducing the effective support area.

U.S. Pat. No. 2,217,517 issued to Leo Lances. This patent teaches a strap made up of a flat rib (stiffener) over which a smooth cloth is wrapped. The rib is sewn to the overlapping edges of the smooth cloth to provide a stitching on the longitudinal center of the outer surface and a rear surface which is entirely smooth. This type of strap is commercially popular even today.

A third problem is the problem of wear. Thus, satin wears out more rapidly and splits when directly stitched to a ribbed elastic material. Shirred materials also wear more rapidly because the threads making up the fabric rub and abrade each other during movement of the wearer. These and other wear problems confront designers whatever the combination of fabrics, stiffeners, elasticized and/or non-elasticized materials used. By way of example, if satin is sewn directly onto an elasticized material as taught by U.S. Pat. No. 2,132,616, it wears more rapidly. This is true even where the fabric is not biased.

Modern brassiere strap designs have used newer materials to circumvent some of the above-described problems. However, no one has effectively solved the curling of wide brassiere straps to provide a comfortable effective result.

Even today, brassiere straps create depressions in the shoulders of large breasted women and even cause sufficient pressure on the underlying nerves to cause tingling or numbness in the arms. Large breasted women often still attach a pad to the strap to seek relief from the cutting action of the modern brassiere strap. These pads are very similar to those used to make back pack straps more comfortable and normally comprise a rounded, elongated pad about twice the width of the strap to be worn having a horizontal cut at each end. The strap, back pack or bra, is inserted under one end, through a horizontal incision, over the pad, through the second horizontal incision, and then attached to the brassiere or back pack. The use of such pads is mute evidence of the failure of garment and pack strap designers to solve the problem of curling and the subsequent cutting of depressions into wearer's shoulders.

A variety of straps are available and marketed by the women's garment industry for use with brassieres, halters and "bra-less" dresses incorporating brassiers into the garment. These straps come in many forms. Quite often, the straps are made of a tricot or cambric tube which is flattened so that the seam centers on one side of the strap. This permits the strap to form a "V" when worn.

Other brassiere straps come in many forms, both plain and embroidered. These straps are normally made of an elastic material which stretches in the longitudinal dimension but not in the latitudinal dimension. The bottom is woven so that it forms a soft, pile surface to provide comfort and/or prevent slippage. The upper surface is smooth and satin-like. A third form of commercial brassiere strap is made of two narrow, longitudinally stretchable fabric ribbons. These ribbons are joined by an elastic netting. Whatever the form, the result, for many women, is the formation of unsightly, and often painful, depressions where the brassiere straps pass over the shoulders.

The strap of this invention substantially overcomes the above problems in an inexpensive, effective manner for bras, halters, bra-less dresses and other devices where the strap is work adjacent the skin.

SUMMARY OF THE INVENTION

An improved strap adapted to be worn adjacent the skin is made up of an elastic ribbon having normal flexibility in the longitudinal direction and limited lateral flexibility. A soft padding covers the elastic ribbon, and a smooth fabric outer covering encloses both. The components of the strap are attached along the longitidinal edges of the strap to form a smooth-faced material surface with undulations (wrinkles) permitting limited longitudinal stretching of the elastic strap to produce a smooth strap surface during wear. The improved elasticized portion makes up a major portion of the strap.

BRIEF DESCRIPTION OF THE DRAWINGS

FIG. 1 is a partially cut-away, upper angular view of one embodiment of the strap of this invention having one elastic portion.

FIG. 2 is a partially cut-away, upper angular view of a portion of a second embodiment of the invention.

FIG. 3 is a partially cut-away view of the lower portion of a third embodiment of the invention as seen from an angle.

FIG. 4 is a partially cut-away view of a brassiere and brassiere strap showing the brassiere strap attached to a bra. The strap has both an elasticized section and two non-elasticized sections.

SPECIFIC DESCRIPTION OF THE DRAWINGS

FIG. 1 is a perspective cut-away of an embodiment of the strap invention having a non-elastic portion 5 made of cambric and an elastic portion 6. The two portions are joined below the edge 7 of the cambric by lateral stitching 8 and zigzag stitching 9 at juncture 10. The elastic portion 5 is made up of an elastic ribbon 11, a non-woven cotton padding material 12, and a nylon satin outer covering 13. The various components of the strap are sewn together as indicated by stitches 14 so that the surface of the satin has ridges or undulations 15. Elastic 11 has inserts 16 which are woven to provide substantial resistance to lateral curling. Padding material 12 completely encircles elastic ribbon 11 and edges 17 and 18 overlap as shown. Satin outer covering 13 completely encircles the padding material 12 and edge 19 overlaps edge 20 which has a turned under portion 21.

FIG. 2 shows an elastic ribbon 22 having substantially rigid enclosed inserts 23. The elastic ribbon 22 is completely enclosed by overlapping padding 24 and padding 24 is covered by a smooth-faced material 25. These materials are held together by stitching 26 represented by dashed lines. The dashed lines continue beyond smooth-face material 25 to indicate that the stitching 26 goes through all the materials making up the strap. Undulations 27 indicate the strap is in the unstretched condition.

FIG. 3 shows a cut-away bottom view of a very heavy duty strap for baby carriers or back packs having an inner elastic ribbon 28 containing filaments 29 (indicated by the borken lines) of a substantially inflexible plastic material which prevents substantial lateral bending or curling. Ribbon 28 has two layers of padding 30 enclosed within a double layer of satin-type material 31. The ribbon 28, padding 30, and satin-type material 31 are sewn together with stitches 32.

FIG. 4 shows a cut-away view of the rear panel 33 and front panel 34 of a brassiere utilizing a strap 35 having a non-elastic section 36 and an elastic section 37. The panels 33 and 34 of the brassiere are shown with decorations 38. The non-stretchable strap portion 36 is sewn to the elastic portion 37 by stitching 39. Sections 36 and 37 have close stitching **39*a* along their longitudinal edges to assist in stabilizing the strap laterally. Stitching 39*b* attaches non-elastic section 36 to rear panel 33. Undulations 40 are shown on the surface of strap portion 37 indicating that the strap is in the unstretched condition. The front panel 34 of the brassiere is connected to a non-elastic strip 41 which is connected to a second non-elastic portion (not shown) of the strap 35 through clip 42 (partially shown). The length of strap 35 is adjusted through use of the adjustment clip 42**.

GENERAL DESCRIPTION OF THE INVENTION

As previously indicated, the straps of this invention are made up of an elastic ribbon including a differentiated stiffening means. A preferred elastic ribbon is Non-Roll Elastic manufactured by Notions, Inc., Van Nuys, CA. and Stretch-Rite Elastic maufactured by the Rhode Island Textile Co. The elastic ribbons stretch in substantially only the longitudinal direction and include integrally woven fibers, fused sections, or inserts which provide substantial resistance to lateral bending. The straps preferably range from ½ inches upward in width, and more preferably are ¾ to 1 inch in width for brassieres, halters, and dresses and 2 to 3 inches for baby carriers and back packs. The desired elastic ribbon characteristics may be provided by an appropriate selection of one or more of weaving pattern, natural or synthetic rubber-based or rubber-like fiber material.

The stiffening inserts and filaments may be of a stiff plastic or other material. The inserts, filaments, and woven stiffener sections may be in one or more layers within the ribbon and multiple ribbon layers can be used. The plastics used to impregnate sections of the ribbon perpendicular to its length are thermoplastic and preferably impregnate the entire depth of the elastic at the fusion points. Preferably the fusion points extend almost to the edges of the ribbon.

Preferably, the depth of the bend from edge-to-edge should be no more than about ¼th of the strap width when stressed by the weight. More preferably the bend should be no more than ⅛th of the strap width when stressed by the weight.

The padding used can be any fleece-like batting material which provides a cushion between the relatively hard surface of the ribbon and the smooth satin material covering. The materials used in the padding can be cotton, or similar natural fiber, or synthetic filaments, such as polyester, polyolefin, or an acrylic. The preferred batting is a non-woven cotton batting used extensively in quilted materials and is preferably about ⅛th inch in thickness for use in garments and upwards of ¼ inch in thickness in pack straps.

Where fibers other than cotton are used, they should have substantially the frictional and padding characteristics of cotton to provide the proper interaction between the elastic ribbon and the smooth fabric material.

The smooth-faced material used to cover the padding is any material having a smooth face on both surfaces. Preferably, the material used to manufacture brassieres has a satin-weave surface, and is satin, satinette or a base material covered with satin or satinette. For other garments which contact the body, the material should have a soft face and should have a low friction surface. Where the garment does not contact the body, the fabric will still be preferably smooth-faced to reduce friction.

A slight excess of smooth-faced material to elastic ribbon is used to create undulations in the surface of the elastic portion of the strap. The material can be made of nylon, polyester, or other synthetic fabric. For brassieres, the material is preferably satin. The undulations are smoothed out by the stretching of the elastic ribbon when the strap is worn. This smoothing limits the elongation of the elastic ribbon. This limitation reduces wear and tear on the ribbon. Preferably the undulations permit no more than ¼th and preferably no more than ⅛th and still more preferably no more than 1/16th of the potential stretching of the elastic to occur. More preferably, where the undulations are formed during the sewing process, the undulations are provided by the natural movement of the pressure foot on the satin during the process of sewing along the longitudinal edge of the strap.

Stitches should be on the order of 8 to 12 per inch and more preferably from 10 to 12 per inch for brassieres and packs. The thread used is preferably cotton or polyfilament nylon, polyester, or other strong commercial thread having an appropriate strength. Clips useful with this invention are any of those normally used to provide adjustment and attachment for brassiere straps. The thread used is preferably cotton, polyfilament, nylon, polyester, or other strong commercial thread having an appropriate strength.

The strength of the smooth-faced elastic and inelastic materials, and the thread, the depth of the padding material and number of stitches should, of course, be appropriate to the use. Thus, the strength of the materials used should be greater in large packs than, for example, in small packs or in brassieres.

Now having described my invention, what I claim is:

1. In a strap for use with garments and packs and adapted for use adjacent the skin, the improvement comprising:

elastic ribbon means adapted to stretch in at least the longitudinal direction and substantially resistant to bending laterally;

padding means enclosing the elastic ribbon means;

smooth-faced material means enclosing the padding means and having a longitudinal excess of smooth-faced material means sufficient to create undulations in the surface of said smooth-faced material means when the elastic ribbon means is unstretched and a smooth surface in said smooth-faced material means when the elastic ribbon means is partially stretched; and stitching means attaching the elastic ribbon means, padding means and smooth-faced material means along each of the longitudinal edges of the strap.

2. The strap of claim 1 including at least one minor non-elastic portion and a major elastic portion.

3. The strap of claim 1 wherein the elastic ribbon means is stiffened laterally by at least one of woven inserts, non-woven inserts, interwoven filaments and fused plastic sections.

4. The strap of claim 1 wherein the elastic ribbon means is stiffened laterally by sections of fused plastic material.

5. The strap of claim 1 wherein the elastic ribbon means is stiffened laterally by filaments woven into the elastic ribbon.

6. The strap of claim 1 wherein the padding means is a non-woven material made of a natural fiber having frictional and padding characteristics similar to those of non-woven cotton batting.

7. The strap of claim 1 wherein the padding means is a non-woven material made of a synthetic fiber having frictional and padding characteristics similar to those of non-woven cotton batting.

8. The strap of claim 3 wherein the elastic ribbon means includes woven inserts and the padding means is a non-woven cotton batting.

9. The strap of claim 1 wherein the smooth-faced material means is a glossy faced material.

10. The strap of claim 1 wherein the smooth-faced material means is a satin material.

11. The strap of claim 1 including at least one multiple layer of elastic ribbon means, padding means and smooth-faced material means.

12. The strap of claim 1 wherein the stitching means includes 10–12 stitches to the inch.

13. The strap of claim 8 including 10–12 stitches per inch.

14. The strap of claim 13 wherein the strap is attached to at least one substantially non-elastic strap material.

15. The strap of claim 14 wherein the at least one inelastic strap means is attached to a brassiere.

16. The strap of claim 14 wherein the at least one inelastic strap means is attached to a pack.

17. The strap of claim 14 wherein the at least one inelastic strap means is attached to a bra-less dress.

18. The strap of claim 14 wherein the padding means is at least about ⅛th inch in depth.

19. The strap of claim 14 further including at least one clip means and wherein the strap is adapted for attachment to at least one of a garment and a pack by means of the at least one clip means.

* * * * *